US005427043A

United States Patent [19]

Conley, Jr. et al.

[11] Patent Number: 5,427,043

[45] Date of Patent: Jun. 27, 1995

[54] WORKPIECE PALLET HAVING A DETACHABLE WORKPIECE HOLDER AND METHOD OF SEWING A WORKPIECE

[75] Inventors: Ralph F. Conley, Jr.; Ricky J. Frye, both of Miamisburg; Christopher J. Kerley, West Carrollton, all of Ohio

[73] Assignee: MIM Industries, Inc., Miamisburg, Ohio

[21] Appl. No.: 676,798

[22] Filed: Mar. 28, 1991

[51] Int. Cl.[6] ..... D05B 21/00

[52] U.S. Cl. ..... 112/262.3; 112/121.12; 112/121.15

[58] Field of Search ..... 112/121.12, 121.15, 112/102, 103, 113, 114, 2, 104, 262.1, 262.3, 266.1; 38/102.2

[56] References Cited

U.S. PATENT DOCUMENTS

| | | | |
|---|---|---|---|
| 164,241 | 6/1875 | Wheeler . | |
| 278,485 | 5/1883 | Arnold . | |
| 1,222,618 | 4/1917 | Gammons . | |
| 1,387,034 | 8/1921 | Barron et al. . | |
| 1,569,231 | 1/1926 | Mayo . | |
| 2,223,626 | 12/1940 | Ladve | 112/2 |
| 2,630,087 | 3/1953 | Liero et al. | 112/114 |
| 2,726,613 | 12/1955 | Eddy | 112/114 |
| 3,104,637 | 9/1963 | Hedegaard | 112/104 |
| 3,664,283 | 5/1972 | McFalls | 112/121.15 |
| 3,664,288 | 5/1972 | Von Boden et al. | 112/103 |
| 3,799,086 | 3/1974 | Block | 112/121.15 |
| 3,830,175 | 8/1974 | Levor | 112/121.12 |
| 3,875,877 | 4/1975 | Fox | 112/63 |
| 3,875,878 | 4/1975 | Kaminski | 112/116 |
| 3,988,993 | 11/1976 | Brophy | 112/121.12 |
| 4,171,672 | 10/1979 | Dorosz et al. | 112/121.12 |
| 4,273,059 | 6/1981 | Kamae | 112/121.14 |
| 4,296,699 | 10/1981 | Vartoukian | 112/121.15 |
| 4,305,338 | 12/1981 | Adamson | 112/113 |
| 4,411,208 | 10/1983 | Nishida et al. | 112/121.12 X |
| 4,455,952 | 6/1984 | Morin et al. | 112/121.12 |
| 4,462,320 | 7/1984 | Scholl | 112/104 |
| 4,479,447 | 10/1984 | Rohr | 112/141 |

(List continued on next page.)

FOREIGN PATENT DOCUMENTS

| | | |
|---|---|---|
| 888574 | 4/1957 | United Kingdom . |
| 991161 | 7/1960 | United Kingdom . |
| 2017769 | 9/1979 | United Kingdom . |
| 2167456 | 9/1984 | United Kingdom . |
| 2143550 | 12/1984 | United Kingdom . |

OTHER PUBLICATIONS

"The Technologies of MIM Industries, Inc." sales brochure, published by MIM Industres approximately Jan. 1, 1990.

*Primary Examiner*—Peter Nerbun

*Attorney, Agent, or Firm*—Biebel & French

[57] ABSTRACT

A workpiece pallet for transporting and holding a workpiece to be sewn in a programmable sewing machine. The workpiece pallet has a first frame member and a second frame member which is pivotally secured to the first frame member. The workpiece pallet also includes a detachable workpiece holder having a first template member and a second template member which can be detachably mounted to the first and second frame members, respectively. In one embodiment, the first template member has a seat and the second template member has a flange which cooperates with the seat in order to removably retain the workpiece in a mounted position in the workpiece holder so that the programmable sewing machine can sew a predetermined stitch pattern on the workpiece. In another embodiment, a support member is used in place of the second template member. The support member has a plurality of fingers which force the workpiece against the seat of the first template member. The fingers can be slidably adjusted in order to accomodate any shaped seat. The workpiece holder can be detached from the workpiece pallet and replaced with a new workpiece holder when necessary to accomodate a workpiece having a different shape or to accomodate a change in the predetermined stitch pattern.

22 Claims, 5 Drawing Sheets

U.S. PATENT DOCUMENTS

| | | | |
|---|---|---|---|
| 4,485,574 | 12/1984 | Bennetot | 112/103 X |
| 4,493,276 | 1/1985 | Sadeh | 112/121.12 |
| 4,498,407 | 2/1985 | Landwehr et al. | 112/308 |
| 4,503,788 | 3/1985 | Giannuzzi et al. | 112/121.12 |
| 4,503,789 | 3/1985 | Scholl | 112/121.14 |
| 4,587,910 | 5/1986 | Raines | 112/121.12 |
| 4,603,647 | 8/1986 | Conley, Jr. et al. | 112/129 |
| 4,622,907 | 11/1986 | Kimura | 112/121.12 |
| 4,664,045 | 5/1987 | Landwehr et al. | 112/153 |
| 4,682,551 | 7/1987 | Toman | 112/103 |
| 4,694,766 | 9/1987 | Wickers et al. | 112/121.12 X |
| 4,696,242 | 9/1987 | Scholl et al. | 112/121.14 |
| 4,706,583 | 11/1987 | Darbenzio | 112/103 |
| 4,708,072 | 11/1987 | Frye | 112/121.27 |
| 4,763,587 | 8/1988 | Frye | 112/121.12 |
| 4,799,438 | 1/1989 | Hishckle | 112/121.12 |
| 4,854,251 | 8/1989 | Hiramatsu et al. | 112/121.12 |
| 4,870,917 | 10/1989 | Frye | 112/121.12 |
| 4,883,006 | 11/1989 | Marii et al. | 112/121.12 |
| 4,920,904 | 5/1990 | Frye | 112/262.1 |
| 4,989,525 | 2/1991 | Portilla | 112/10 |
| 5,074,230 | 12/1991 | Morii | 112/121.15 |

WORKPIECE PALLET HAVING A DETACHABLE WORKPIECE HOLDER AND METHOD OF SEWING A WORKPIECE

BACKGROUND OF THE INVENTION

1. Field of the Invention

This invention relates to a workpiece pallet for use in a programmable sewing machine, and more particularly, it relates to a workpiece pallet having a detachable workpiece holder which can be detachably secured to the workpiece pallet so that the workpiece pallet can accomodate workpieces having different shapes.

2. Description of Related Art

In the sewing industry, a common repetitive function is to sew a predetermined stitch pattern on a label or workpiece of material. To facilitate producing a large number of identical workpieces, a workpiece pallet was used to hold the workpiece while the predetermined stitch pattern was being sewn thereon. The workpiece pallet of the prior art was typically a one-piece construction having a bottom plate and a top plate which was secured directly to the bottom plate. The top and bottom plates would be machined to have an opening corresponding to the size and shape of the workpiece to be sewn to the panel. A workpiece would be placed on the bottom plate and the top plate would be pivoted so as force the workpiece against the bottom plate, thereby securing the workpiece in the workpiece pallet. Once the workpiece was secured between the top and bottom plates the workpiece pallet would then be moved to a sewing station where the predetermined stitch pattern could be sewn on the workpiece.

Because workpieces usually have different shapes and sizes, each workpiece would require its own workpiece pallet having top and bottom plates which are specifically machined to fit that workpiece. Thus, these workpiece pallets could not accomodate different sized workpieces. It was also necessary to change the workpiece pallet for the same workpiece if it was desired to sew a different predetermined stitch pattern on the workpiece.

SUMMARY OF THE INVENTION

A primary object of this invention is to provide a workpiece pallet which can accomodate workpieces having different sizes and shapes.

In one aspect, this invention includes a workpiece pallet for use in a programmable sewing machine having a sewing station, said workpiece pallet comprising: a frame; and a workpiece holder detachably secured to the frame for holding a workpiece in the frame; said workpiece holder being capable of removably securing the workpiece in the frame so that the programmable sewing machine can sew a predetermined stitch pattern on the workpiece when the workpiece pallet is positioned at the sewing station.

In another aspect, this invention includes a workpiece holder for holding a workpiece in a workpiece pallet; said workpiece holder comprising: a template member; securing means for removably securing the workpiece to the template member so that a predetermined stitch pattern can be sewn on the workpiece when the workpiece holder is detachably secured to the workpiece pallet and the workpiece pallet is position at a sewing station in a programmable sewing machine.

Another object of this invention is to provide a detachable workpiece holder for removably securing a workpiece in a workpiece pallet so that a predetermined stitch pattern can be sewn on the workpiece.

Another object of this invention is to provide a workpiece pallet which eliminates the need for providing a workpiece pallet for each workpiece having a different shape or size.

Another object of this invention is to provide a workpiece pallet which eliminates the need for providing a workpiece pallet for each workpiece whenever the predetermined stitch pattern to be sewn on the workpiece changes.

Another object of this invention is to provide a first template member and means for securing a workpiece against the first template member, whereby the first template member and the securing means are detachable from a workpiece pallet.

Still another object of this invention is to provide a detachable workpiece holder which can be detached and secured to a workpiece pallet without the use of tools.

Yet another object of this invention is to provide a method which permits an operator to quickly and easily change a workpiece holder in a workpiece pallet, thereby improving the operators efficiency in using the programmable sewing machine.

These objects, and others, may be more readily understood in connection with the following specification, claims, and drawing.

DESCRIPTION OF THE PREFERRED EMBODIMENT

Figure 1:
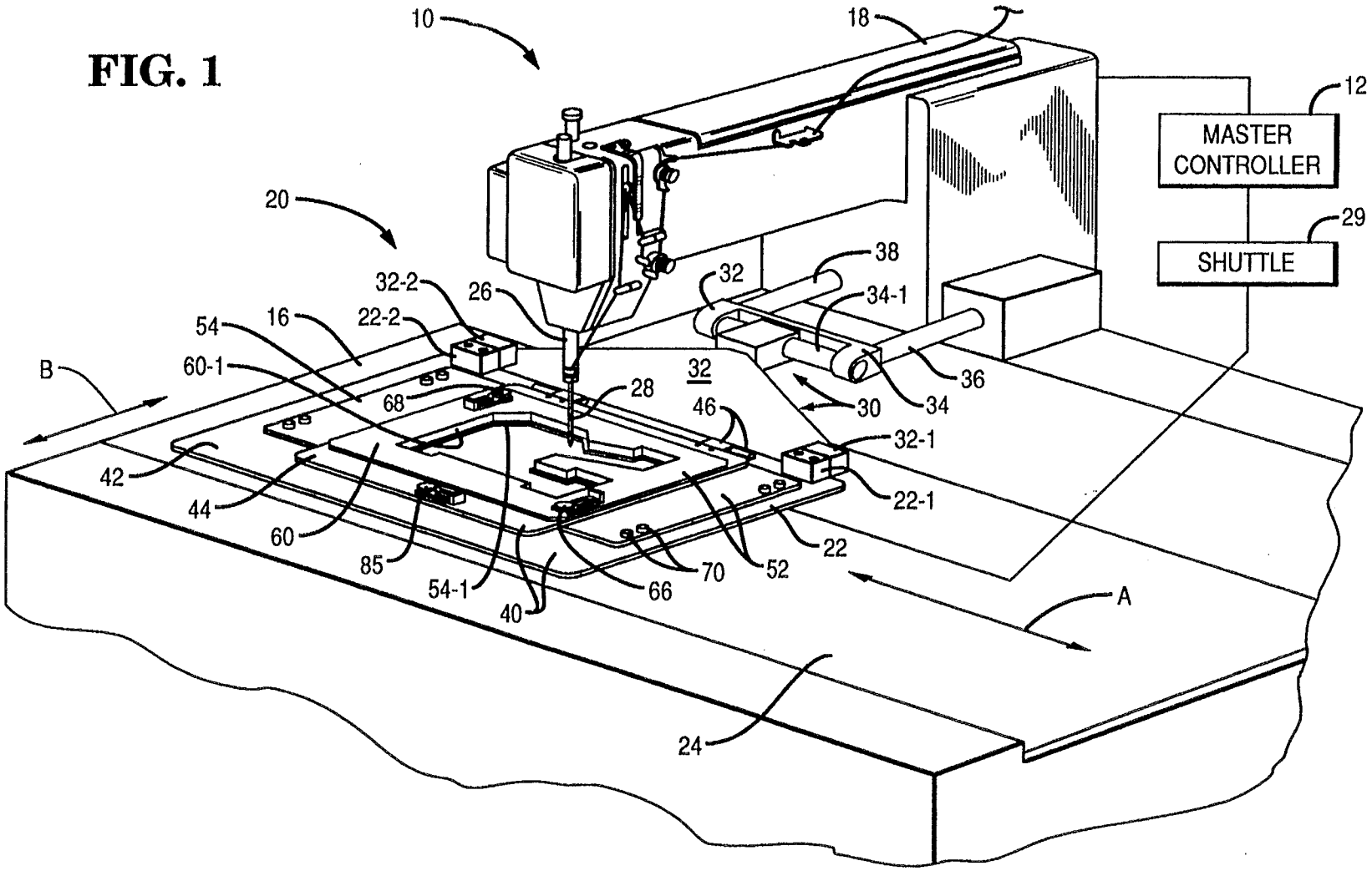
FIG. 1 is a perspective view of a programmable sewing machine in which a preferred embodiment of this invention may be used.
Figure 4:
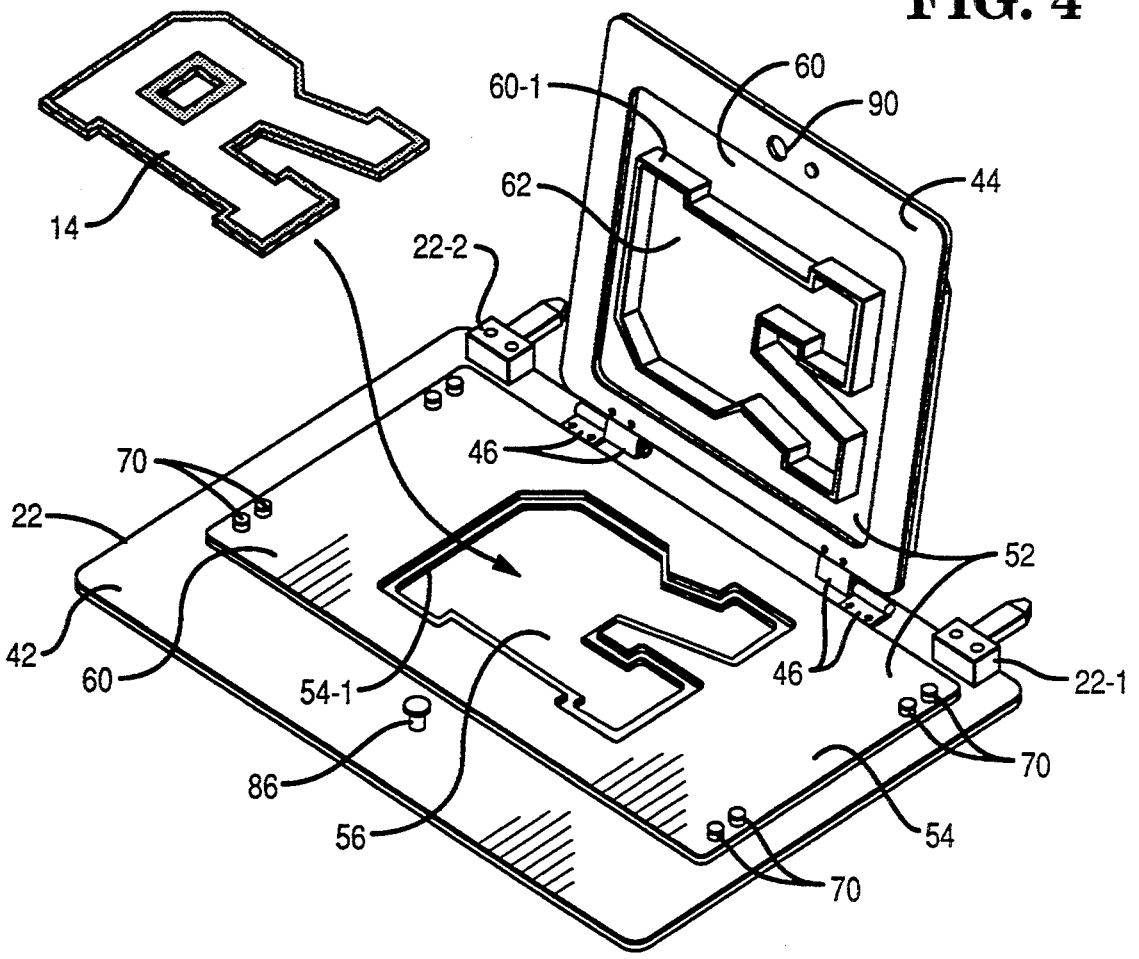
FIG. 4 is a perspective assembled view of the workpiece pallet, showing the first and second frame members in an open position and also showing how a workpiece may be inserted in the workpiece pallet.
Figure 5:
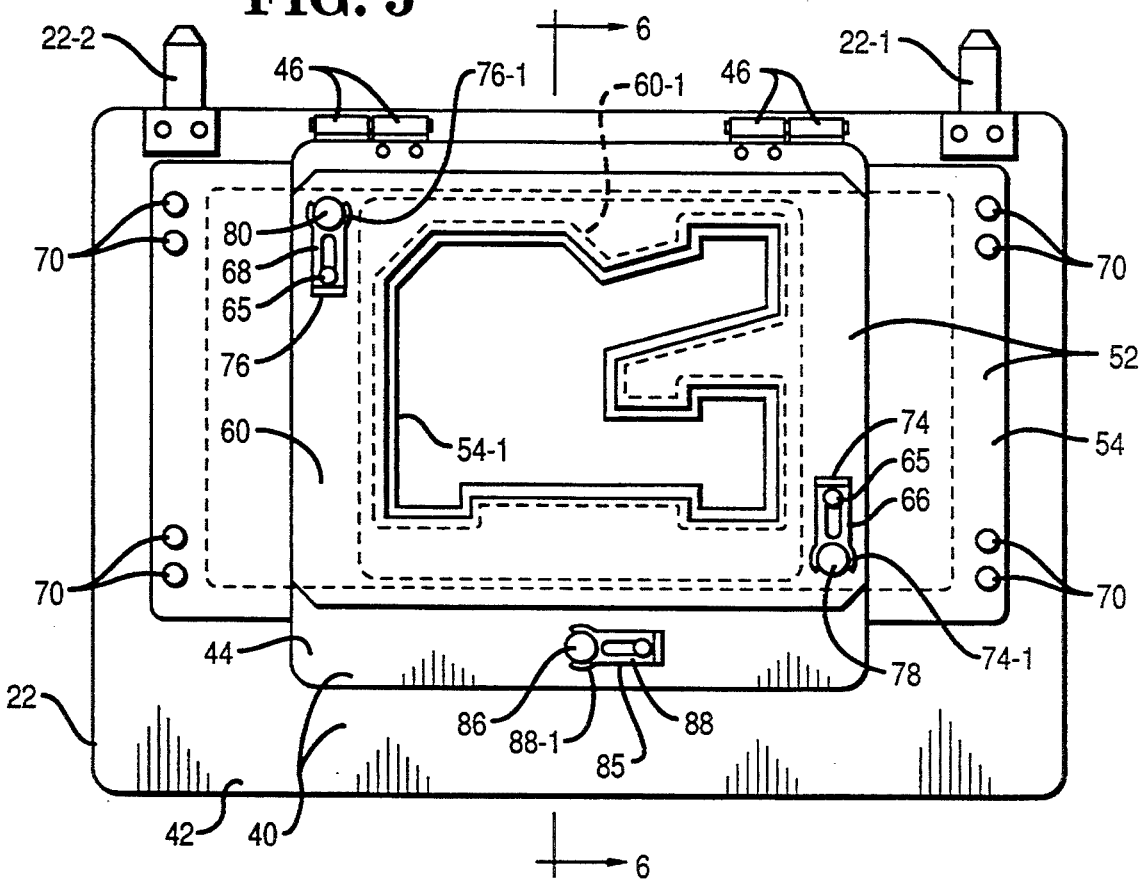
FIG. 5 is a top view of the workpiece pallet; showing details of the means for fastening a first template member to the first frame member and a second template member to the second frame member.

FIG. 1 shows a perspective view of a programmable sewing machine, hereinafter designated as sewing machine 10, in which a preferred embodiment of this invention may be used. The function of the sewing machine 10 is to sew a predetermined stitch pattern (not shown) on a workpiece 14 (FIG. 4), such as a label, according to a computer program (not shown) which is controlled by a master controller 12 (FIG. 1) in the sewing machine 10. In the embodiment being described, the sewing machine 10 may be any programmable sewing machine, including the Brother BAS Series 300 programmable sewing machines, such as the BAS Model 340, which are manufactured by Brother Industries of Japan. The sewing machine 10 comprises a base 16 having a horizontal arm 18 secured thereto. The sewing machine 10 also comprises a sewing station 20 at which the predetermined stitch pattern can be sewn on the workpiece 14 (FIG. 4). The sewing station 20 (FIG. 1) includes a sewing surface 24 which supports a workpiece pallet 22. As best illustrated in FIG. 1, the horizontal arm 18 extends out over the sewing surface 24, and it has a needle holder 26 near the end thereof. The needle holder 26 supports a needle 28 for reciprocating motion in a fixed path that is generally vertical and perpendicular to the sewing surface 24. The needle 28 moves down through a hole (not shown) in a throat plate (not shown) at the bottom of its stroke to transfer a loop of thread to a looptaker (not shown) under the sewing surface 24 at the sewing station 20. The looptaker and needle 28 are both connected to a motor (not shown) which is controlled by the master controller 12 in the sewing machine 10.

In the embodiment being described, the sewing machine 10 also includes a shuttle 29 for shuttling the workpiece pallet 22 towards and away from the sewing station 20. The shuttle 29 includes a belt and pulley arrangement (not shown) having means (not shown) for coupling the workpiece pallet 22 to the belt in order to move the workpiece pallet 22 towards and away from the sewing station 20. It is to be noted, however, that the shuttle 29 could be any suitable means capable of shuttling the workpiece pallet 22 toward and away from the sewing station 20. The sewing machine 10 further includes a driver or drive means 30 for moving the workpiece pallet 22 at the sewing station 20 in accordance with the program (not shown) stored in the sewing machine 10 so that the predetermined stitch pattern can be sewn on the workpiece 14. The drive means 30 comprises a pallet support 32 which includes a first receiving member 32-1, and a second receiving member 32-2. The pallet support 32 is coupled to a yoke shaft 34-1 of a yoke 34 which permits the workpiece pallet 22 to move in an X direction, indicated by double arrow A in FIG. 1. The yoke 34 is coupled to a pair of shafts 36 and 38 which can cause the yoke 34 and pallet support 32 to move in a Y direction, indicated by double arrow B in FIG. 1. The shafts 36 and 38 are coupled to a stepper motor (not shown) by various belts, gears and pulleys (not shown) in the sewing machine 10. The pallet support 32 is coupled by various belts, gears and pulleys (not shown) to a second stepper motor (not shown) within the base 16. The stepper motor and second stepper motor are included as part of the drive means 30, and they are both coupled to the master controller 12 in the sewing machine 10. The master controller 12 can selectively energize the stepper motor and second stepper motor individually or simultaneously to move the workpiece pallet 22 in the X or Y directions, thereby permitting the sewing machine 10 to move the workpiece pallet 22 in accordance with the program so that the predetermined stitch pattern can be sewn on the workpiece 14. As best shown in FIGS. 2, 3, 4 and 5, the workpiece pallet 22 comprises a first connector 22-1 and a second connector 22-2 which are received by the first and second receiving members 32-1 and 32-2, thereby securing the workpiece pallet 22 to the drive means 30. It is to be noted that the driver or drive means 30 could be any suitable means which is capable of moving the workpiece pallet 22 in accordance with the program.

Figure 7:
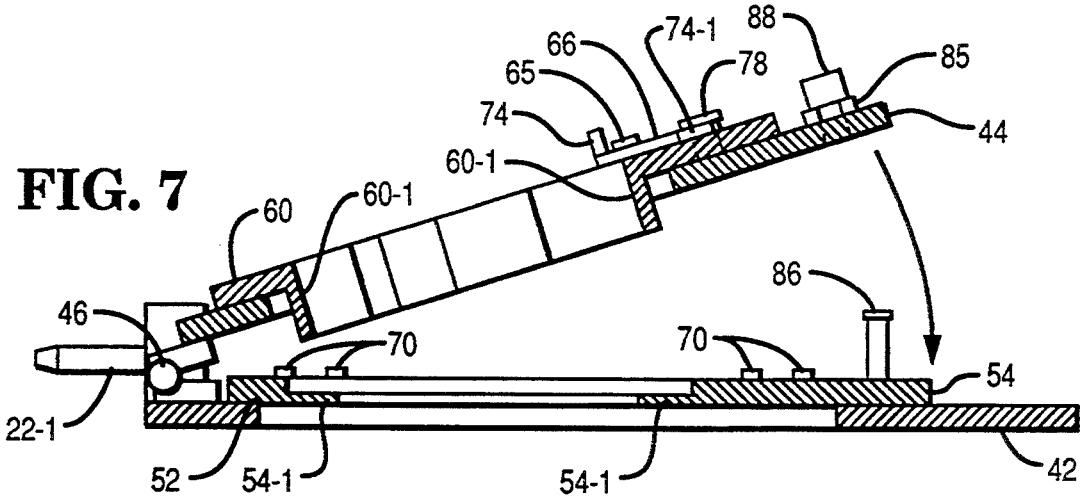
FIG. 7 is a sectional view of the workpiece pallet as shown in FIG. 6, showing the first and second frame members in an open position.

The sewing machine 10 further comprises the workpiece pallet 22 mentioned previously herein. The function of the workpiece pallet 22 is to secure the workpiece 14 while the workpiece 14 is being transported towards and away from the sewing station 20 by the shuttle 29. Another function of the workpiece pallet 22 is to secure the workpiece 14 during the sewing operation when the master controller 12 energizes the drive means 30 to move the workpiece pallet 22 in accordance with the program (not shown) so that the predetermined stitch pattern can be sewn on the workpiece 14. The workpiece pallet 22 includes a frame 40 (FIG. 3) having a first frame member 42 (FIGS. 2, 3 and 4) and a second frame member 44. A pair of hinges 46 couple the second frame member 44 to the first frame member 42 and permit the first and second frame members 42 and 44 to pivot between a closed position (shown in FIG. 3) and an open position (shown in FIGS. 4 and 7). In a preferred embodiment, the first frame member 42 (FIG. 2) is rectangular and defines a generally rectangular aperture 48, and the second frame member 44 is also rectangular and defines a generally rectangular aperture 50.

The workpiece pallet 22 also includes a workpiece holder 52 which is supported by the frame 40. The function of the workpiece holder 52 is to hold the workpiece 14 so that the sewing machine 10 can sew the predetermined stitch pattern to be sewn on the workpiece 14 when the workpiece holder 52 is detachably secured to the workpiece pallet 22 and the workpiece pallet 22 is positioned at the sewing station 20. In the embodiment being described, the workpiece holder 52 comprises a first template member 54 which has an aperture 56 surrounded by a seat 54-1. As best shown in FIG. 4, the workpiece 14 has an outer edge portion 14-1. The seat 54-1 is capable of receiving and supporting the outer edge portion 14-1.

Figure 2:
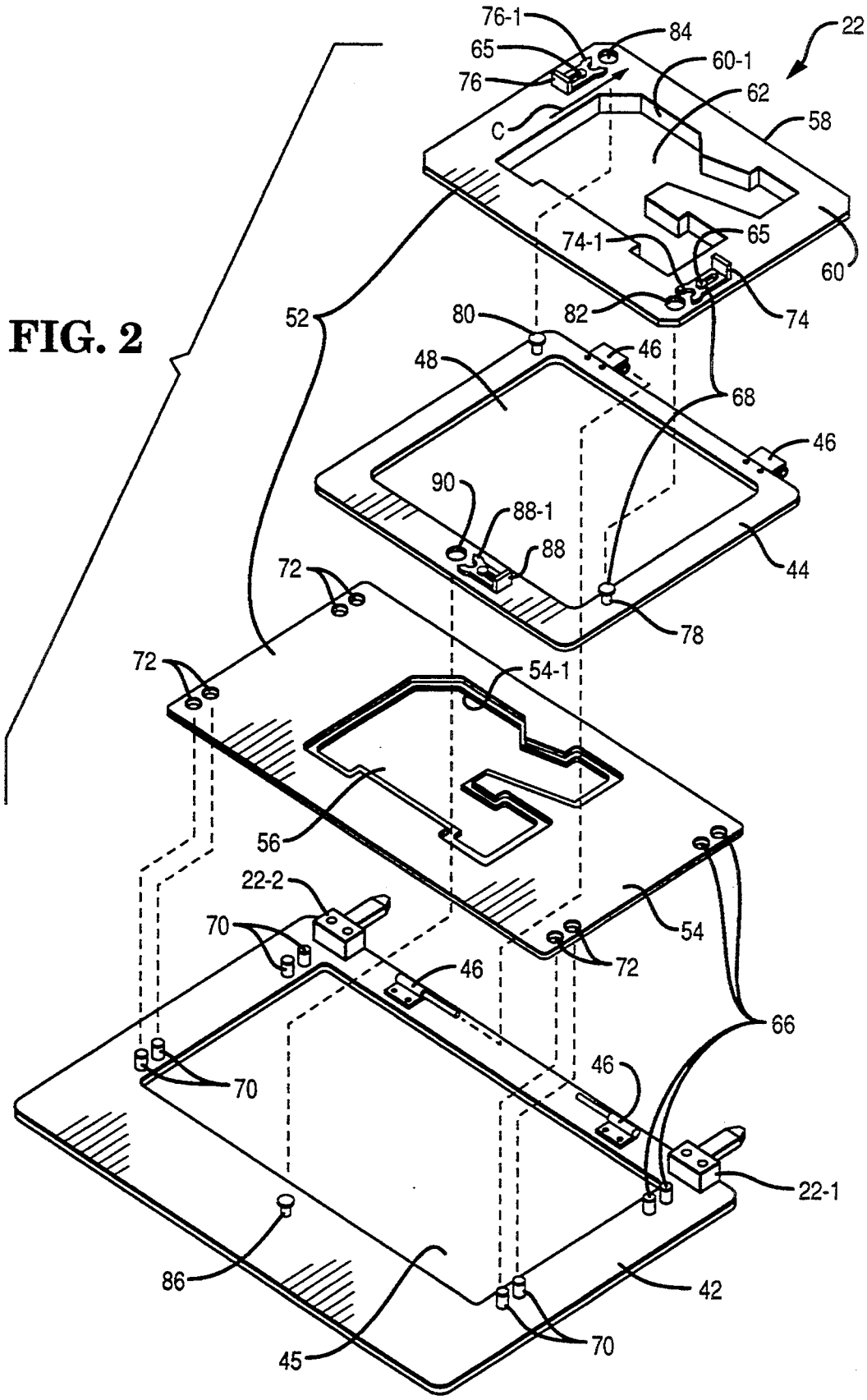
FIG. 2 is a perspective exploded view of a workpiece pallet.
Figure 3:
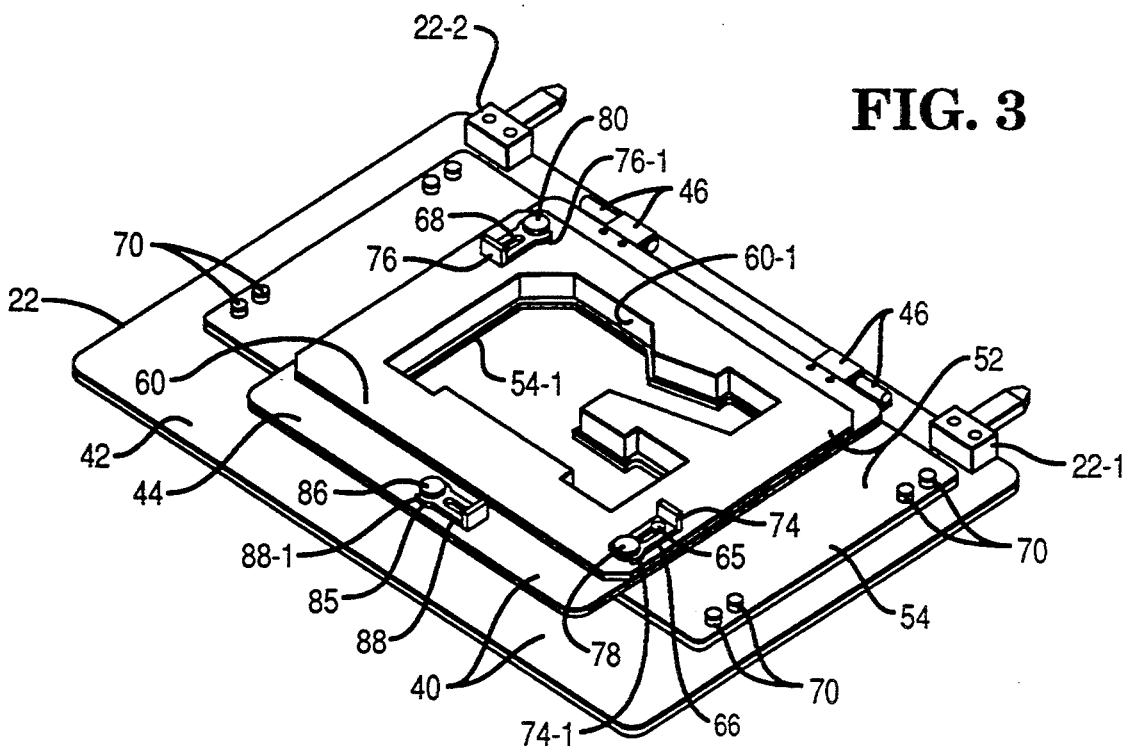
FIG. 3 is a perspective assembled view of the workpiece pallet shown in FIG. 2, showing a first frame member and a second frame member in a closed position.
Figure 6:
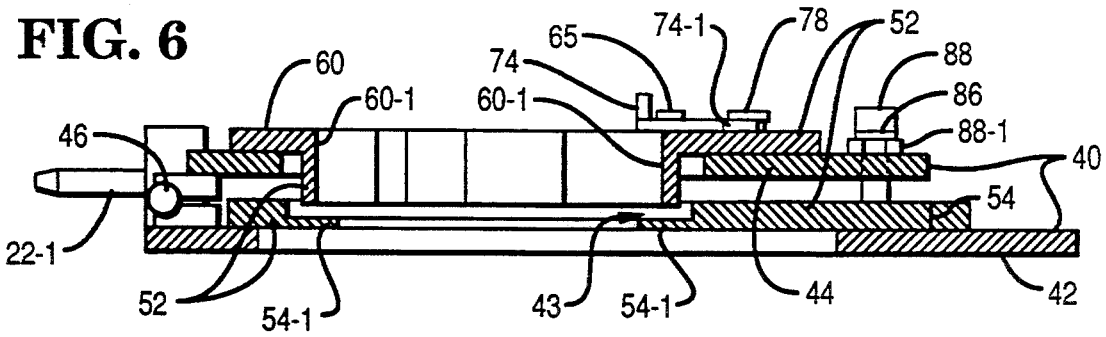
FIG. 6 is a sectional view, taken along the line 6—6 in FIG. 5, showing a flange on the second template member being in operative relationship with a seat in the first template member.

The workpiece holder 52 also includes securing means or means for removably securing the workpiece 14 to the first template member 54 over the workpiece 14 is secured in the seat 54-1. In one embodiment of the invention, the securing means includes a second template member 60 which cooperates with the first template member 54 to secure the workpiece 14 in the workpiece holder 52 when the second template member 60 is placed in operative relationship with the first template member 54. As illustrated in FIG. 2, the second template member 60 has an aperture 62 surrounded by a flange 60-1. It is to be noted that the apertures 56 and 62 generally correspond to the shape of the workpiece 14 and the predetermined stitch pattern to be sewn on the workpiece 14. The shape of the flange 60-1 may change if the shape of the workpiece 14 changes or if it is desired to change the shape of the predetermined stitch pattern. As best illustrated in FIG. 6, the flange 60-1 is capable of forcing the outer edge 14-1 of the workpiece 14 against the seat 54-1 when the first and second frame members 42 and 44 are pivoted to the closed position, thereby securing the workpiece 14 in the workpiece pallet 22. When the first and second frame members 42 and 44 are in the closed position, there is an area 43 between the flange 60-1 and seat 54-1 wherein the outer edge portion 14-1 of the workpiece 14 is "pinched" in order to secure the workpiece 14 in the workpiece holder 52.

Figure 8:
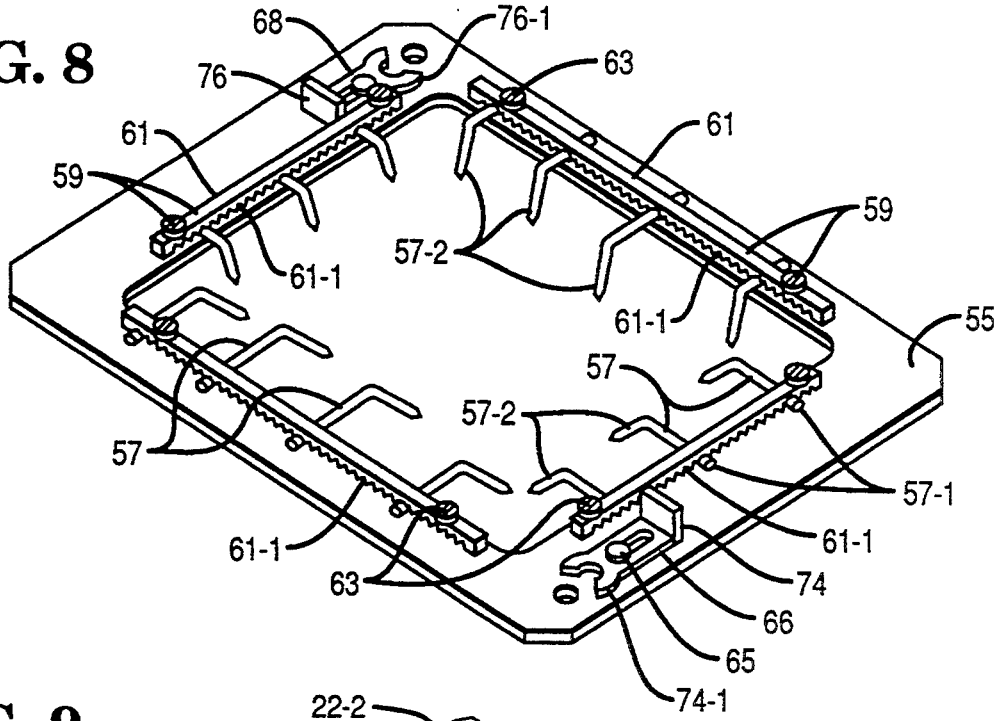
FIG. 8 is a perspective view of a support member which can be used in place of the second template member, showing a plurality of fingers fastened on the support member.
Figure 9:
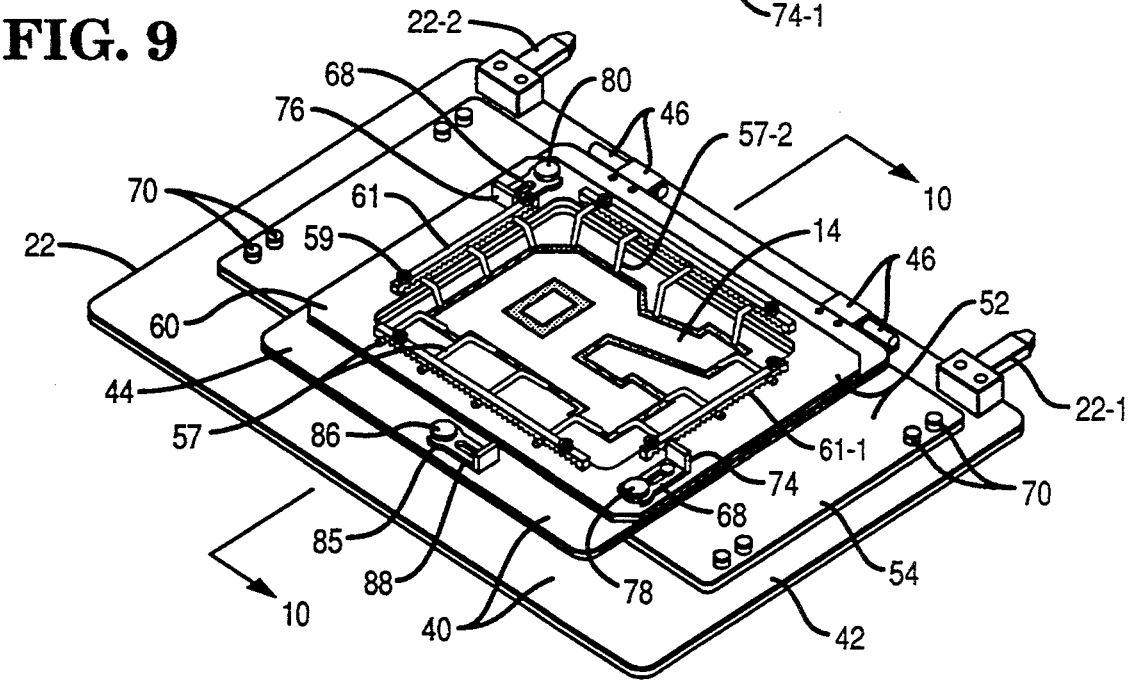
FIG. 9 is a perspective view showing the workpiece pallet with the support member of FIG. 8 mounted thereon.
Figure 10:
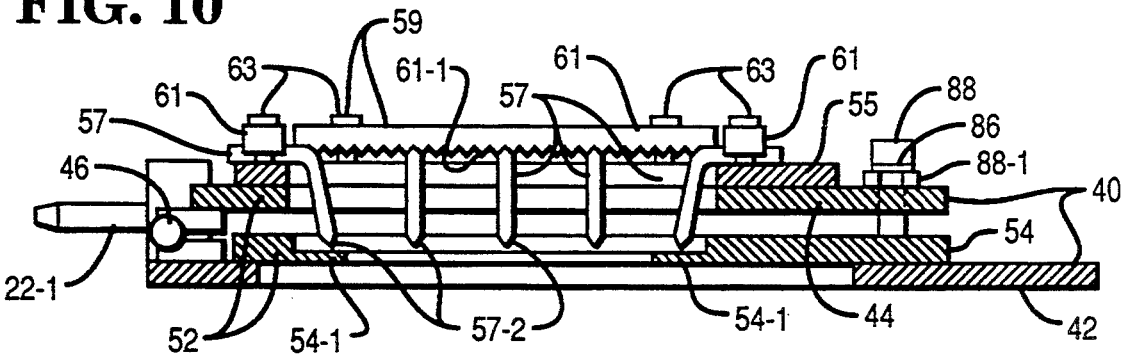
FIG. 10 is a sectional view of the workpiece pallet shown in FIG. 9, taken along the line 10—10 in FIG. 9.

FIGS. 8, 9 and 10 show another embodiment of this invention in which the securing means includes a template or support member 55 which can be used in place of the second template member 60. Those parts of the support member 55 which are identical to the corresponding parts on the second template member 60 are given the same part numbers. The support member 55 has a plurality of fingers 57 each having a first end 57-1 and a second end 57-2. The support member 55 also includes an adjustment means 59 for adjustably securing the plurality of fingers 57 to the support member 55 in order to permit the second ends 57-2 to force the outer edge 14-1 of the workpiece 14 against the seat 54-1 when the first and second frame members 42 and 44 are in a closed position. As best shown in FIGS. 8 and 9, the adjusting means 59 includes a plurality of retaining bars 61 which are secured to the support member 55 by suitable fasteners, such as screws 63. As best shown in FIG. 9, the retaining bars 61 each have a toothed surface 61-1 which facilitates securing the first ends 57-1 against the support member 55. Although the adjusting means 59 is described herein as including the retaining bar 61, it could be any suitable means for adjustably fastening the plurality of fingers 57 against the support member 55. A feature of the adjusting means 59 is that it enables the plurality of fingers 57 to be adjustably secured to the support member 55 so that the position of the second ends 57-2 can be adjusted, for example, in order to accomodate first template members 54 with different shaped seats 54-1. The support member 55 mounts on the second frame member 44 in the same manner as described below for securing the second template member 60 to the second frame member 44.

The workpiece pallet 22 also comprises means for fastening the workpiece holder 52 to she frame 40. The fastening means includes a first fastener 66 for securing the first template member 54 to the first frame member 42 and a second fastener 68 for securing the second template member 60 to the second frame member 44. In the embodiment being described, the first fastener 66 includes a plurality of projections, such as 70, which are Located on the first frame member 42. The first template member 54 includes a plurality of apertures, such as 72, which mate with and receive the projections 70. The apertures 72 are aligned with the projections 70 when it is desired to detachably secure or fasten the first template member 54 to the first frame member 42. The apertures 72 can be slip fit onto the projections 70, thereby permitting the first template member 54 to be detachably secured to the first frame member 42.

The second fastener 68 is comprised of a first locking member 74 and a second locking member 76. The first and second locking members 74 and 76 are slidably secured to the second template member 60 by any conventional means, such as by screws or rivets 65. The second fastener 68 further includes a first post member 78 and a second post member 80 which upstand from the second frame member 44, as shown in FIG. 2. The second template member 60 has a first slot 82 and a second slot 84 which are capable of receiving the first and second post members 78 and 80, respectively. When it is desired to detachably mount the second template member 60 onto the second frame member 44, the first and second slots 82 and 84 received by the first and second post members 78 and 80. The second locking member 76 has a C-shaped end 76-1 which is slid in the direction of arrow C in FIG. 2 until it is forced or snap fitted into locked engagement with the second post member 80. Likewise, the first locking member 74 has a C-shaped end 74-1 which is forced or snap fitted against the first post member 78 in order to lock the first locking member 74 against the first post member 78. The second template member 60 becomes detachably fastened to the second frame member 44 when the first and second locking members 74 and 76 become locked with the first and second post members 78 and 80. Although not shown, the fastening means described herein could be any suitable means capable of fastening the first and second template members 54 and 60 to the first and second frame members 42 and 44, respectively.

The workpiece pallet 22 further comprises a means for fastening the first frame member 42 and the second frame member 44 in the closed position. This second fastening means includes a third fastener 85 having a third post member 86 located on said first frame member 42 and a third locking member 88 which is located on the second frame member 44. The second frame member 44 includes a third slot 90 which is capable of receiving the third post member 86. The third locking member 88 has a C-shaped end 88-1 which is snap or force fit to lock against the third post member 86 after the second frame member 44 is pivoted from the open position to the closed position. The means for fastening the first and second frame members 42 and 44 together could be any suitable means which is capable of fastening the first and second frame members 42 and 44 together.

A method for sewing the predetermined stitch pattern on the workpiece 14 using the sewing machine 10 will now be described. The first and second template members 54 and 60, which have apertures 56 and 62, respectively, generally correspond to the shape of the workpiece 14, are selected. The first template member 54 is then detachably fastened to the first frame member 42, and the second template member 60 is detachably fastened to the second frame member 44. With the first and second frame members 42 and 44 in the open position (FIGS. 4 and 7), the operator can then "load" the workpiece pallet 22 by placing a workpiece 14 in the seat 54-1 of the first template member 54 so that the outer edge portion 14-1 is supported by the seat 54-1. The second frame member 44 would then be pivoted to the closed position (FIG. 3) where the flange 60-1 of the second template member 60 would force the outer edge portion 14-1 of the workpiece 14 against the seat 54-1, thereby securing the workpiece 14 in the workpiece holder 52. The first and second frame members 42 and 44 would then be locked or fastened in the closed position by sliding the third locking member 88 into locked engagement with the third post member 86, as described previously herein. The master controller 12 may then energize the shuttle 29 to shuttle the workpiece pallet 22 towards the sewing station 20 until the first and second connectors 22-1 and 22-2 become aligned with and received by the first and second receiving members 32-1 and 32-2, respectively. The master controller 12 can then move the workpiece pallet 22 in the X and Y directions in accordance with the program so that the sewing machine 10 sews the predetermined stitch pattern on the workpiece 14. After the sewing operation is completed, the shuttle 29 shuttles the workpiece pallet 22 away from the sewing station 20. The third locking member 88 is then unlocked and the first and second frame members 42 and 44 are pivoted to the open position where the sewn workpiece 14 can be removed.

If it were desired to sew a different predetermined stitch pattern or to sew a new workpiece 14 having a different shape than the workpiece 14 previously being sewn, then the workpiece holder 52 would be dismounted from the frame 40 and a new workpiece holder 52 would then be secured to the frame 40. In this regard, the first template member 54 would be detached or dismounted from the first frame member 42. A new first template member 54 having an aperture 56 corresponding to the shape of the new workpiece 14 would be detachably secured to the first frame member 42. Likewise, the second template member 60 would be dismounted from the second frame member 44, and a new second template member 60 having a second aperture 62 corresponding to the shape of the new workpiece 14 would be fastened to the second frame member 44 in the manner described previously herein. The first and second template members 54 and 60 may then cooperate to secure the new workpieces 14 in the workpiece pallet 22. The workpiece pallet 22 can then be shuttled to the sewing station 20 so that the predetermined stitch pattern can be sewn on the workpiece as described earlier herein. It can be seen that when it is desired to sew a different predetermined stitch pattern or a workpiece 14 having a different shape, the workpiece holder 52 can be changed easily and quickly.

Although not shown, it may be desirable to have two workpiece pallets 22 to facilitate increasing the productivity of an operator. In such an operating environment, an operator could load one workpiece pallet 22 while another workpiece pallet 22 having a workpiece 14 secured therein is located at the sewing station 20 so that the predetermined stitch pattern can be sewn thereon.

Various changes or modifications in the invention described may occur to those skilled in the art without departing from the spirit or scope of the invention. The above description of the invention is intended to be illustrative and not limiting, and it is not intended that the invention be restricted thereto but that it be limited only by the true spirit and scope of the appended claims.

What is claimed is:

1. A workpiece pallet for use in a programmable sewing machine having a sewing station, said workpiece pallet comprising:

a frame for receiving at least one of a plurality of workpiece holders;

each of said plurality of workpiece holders having securing means for securing a workpiece, each of said plurality of workpiece holders also having a cut-out portion having a shape corresponding to a predetermined stitch pattern; at least one of the plurality of workholders having a cut-out portion which is non-circular; and fastening means for detachably fastening at least one of said plurality of workpiece holders to the frame, said fastening means enabling the workpiece pallet to accommodate workpieces of different shapes and also enabling the workpiece pallet to secure workpieces which are to be sewn with different predetermined stitch patterns;

said frame comprising:

a first frame member; and a second frame member pivotally secured to said first frame member;

said first and second frame members being capable of pivoting between an open position and a closed position.

2. The workpiece pallet as recited in claim 1 wherein said frame further comprises:

second fastening means for fastening said first and second frame members in said closed position.

3. A workpiece pallet for use in a programmable sewing machine having a sewing station, said workpiece pallet comprising:

a frame, said frame comprising a first frame member which is pivotably secured to a second frame member; and a workpiece holder detachably secured to said frame for holding a workpiece in said frame;

said workpiece holder being capable of removably securing said workpiece in said frame so that said programmable sewing machine can sew a predetermined stitch pattern on the workpiece when the workpiece pallet is positioned at the sewing station, said workpiece holder having a cut-out portion corresponding to the predetermined stitch pattern.

4. A workpiece pallet for use in a programmable sewing machine having a sewing station, said workpiece pallet comprising:

a frame; and a workpiece holder detachably secured to said frame for holding a workpiece in said frame;

said workpiece holder being capable of removably securing said workpiece in said frame so that said programmable sewing machine can sew a predetermined stitch pattern on the workpiece when the workpiece pallet is positioned at the sewing station;

said workpiece holder further comprising:

a first template member; and a second template member;

said first and second template members cooperating to secure the workpiece in the workpiece pallet;

said workpiece having an outer edge portion;

said first template member having an aperture surrounded by a seat for receiving the outer edge portion of the workpiece;

said second template member having means for forcing the outer edge portion against said seat in order to secure the workpiece in the workpiece holder when the workpiece is placed in said seat and said first and second frame members are in said closed position.

5. The workpiece pallet as recited in claim 4 wherein the second template member comprises a second aperture surrounded by a flange;

said flange forcing said outer edge portion of the workpiece against the seat of the first template member in order to secure the workpiece in the workpiece holder when the workpiece is placed in said seat and said first and second template members are in said closed position.

6. The workpiece pallet as recited in claim 4 wherein the second template member further comprises:

a plurality of fingers, each of said plurality of fingers having a first end and a second end; and adjustment means for adjustably securing said first ends of said plurality of fingers to said first template member in order to permit said second ends to force said outer edge portion of the workpiece against the seat when said first and second frame members are in said closed position.

7. The workpiece pallet as recited in claim 5 wherein said aperture and said second aperture are shaped so as to generally correspond to the shape of said predetermined stitch pattern.

8. A workpiece pallet for use in a programmable sewing machine having a sewing station, said workpiece pallet comprising:

a frame, said frame comprising a first frame member which is pivotably secured to a second frame member; and a workpiece holder detachably secured to said frame for holding a workpiece in said frame;

said workpiece holder being capable of removably securing said workpiece in said frame so that said programmable sewing machine can sew a predetermined stitch pattern on the workpiece when the workpiece pallet is positioned at the sewing station, said workpiece holder having a cut-out portion corresponding to the predetermined stitch pattern;

said first template member having a plurality of apertures; said first fastener further including a plurality of projections which are located on the first frame member and which can be received in said plurality of apertures;

said second fastener further including at least one sliding lock member which is located on the second template member, said at least one sliding lock member cooperating with a post on the second frame member to secure the second template member to the said frame member.

9. A workpiece holder for holding a workpiece in a workpiece pallet; said workpiece holder comprising:

a template member;

securing means for removably securing the workpiece to said template member so that a predetermined stitch pattern can be sewn on the workpiece when the workpiece holder is detachably secured to the workpiece pallet and the workpiece pallet is positioned at a sewing station in a programmable sewing machine;

said securing means further comprising:

a support member having a plurality of fingers adjustably secured thereto;

said plurality of fingers being capable of engaging the workpiece and forcing the workpiece against the template member when the support member is placed in an operative relationship with said template member, thereby securing the workpiece in said workpiece holder.

10. The workpiece holder as recited in claim 9 wherein said template member has an aperture surrounded by a seat, said seat being capable of supporting the workpiece and said aperture having a shape which generally corresponds to said predetermined stitch pattern;

each of said plurality of fingers having a first end adjustably secured to said support member and a second end which is capable of engaging the workpiece and forcing a portion of the workpiece against the seat of the template member, thereby securing the workpiece in said workpiece holder.

11. A workpiece holder for holding a workpiece in a workpiece pallet; said workpiece holder comprising:

a template member;

securing means for removably securing the workpiece to said template member so that a predetermined stitch pattern can be sewn on the workpiece when the workpiece holder is detachably secured to the workpiece pallet and the workpiece pallet is positioned at a sewing station in a programmable sewing machine;

said workpiece pallet further comprising:

a first support member, said template member being detachably secured to said first support member; and a second support member pivotally secured to said first support member, said first and second support members being capable of pivoting between an open position and a closed position;

said securing means further comprising:

a second template member detachably secured to said second support member;

said second template member cooperating with said template member to secure the workpiece in said workpiece holder when said first and second support members are in said closed position.

12. The workpiece holder as recited in claim 11 wherein said template member has an aperture surrounded by a seat, said seat being capable of supporting the workpiece and said aperture having a shape which generally corresponds to said predetermined stitch pattern;

said second template member having a flange thereon which is capable of forcing the workpiece against said seat in order to retain the workpiece in the workpiece holder when said first and second support members are in said closed position.

13. A workpiece holder for holding a workpiece in a workpiece pallet; said workpiece holder comprising:

a template member;

securing means for removably securing the workpiece to said template member so that a predetermined stitch pattern can be sewn on the workpiece when the workpiece holder is detachably secured to the workpiece pallet and the workpiece pallet is positioned at a sewing station in a programmable sewing machine;

said workpiece pallet further comprising:

a first support member, said template member being detachably secured to said first support member; and a second support member pivotally secured to said first support member, said first and second support members being capable of pivoting between an open position and a closed position;

said securing means further comprising:

a finger support having a plurality of fingers adjustably secured thereto, said finger support being detachably secured to said second support member;

said plurality of fingers being capable of engaging the workpiece and forcing the workpiece against the template member when the finger support is placed in an operative relationship with said template member, thereby securing the workpiece in said workpiece holder.

14. The workpiece holder as recited in claim 13 wherein said template member has an aperture surrounded by a seat, said seat being capable of supporting the workpiece and said aperture having a shape which generally corresponds to said predetermined stitch pattern;

each of said plurality of fingers having a first end adjustably secured to said finger support and a second end which is capable of engaging the workpiece and forcing the workpiece against the seat of the template member, thereby securing the workpiece in said workpiece holder.

15. A programmable sewing machine having a sewing station, said programmable sewing machine being capable of sewing a predetermined stitch pattern on a workpiece located at said sewing station; said programmable sewing machine comprising:

a controller for controlling the operation of the programmable sewing machine;

a workpiece pallet for holding a workpiece at the sewing station so that the predetermined stitch pattern can be sewn on the workpiece;

said workpiece pallet comprising:

a first support member;

a second support member pivotally secured to said first support member;

a first template member;

a second template member; said first and second template members each providing a template of said predetermined stitch pattern;

a first fastener for detachably fastening said first template member to said first support member;

a second fastener for detachably fastening said second template member to said second support member;

said first and second template members having means for removably securing said workpiece in said workpiece pallet when said first and second support members are pivoted to a closed position; and a third fastener for fastening said first and second support members in said closed position; and a driver coupled to said controller for moving said workpiece pallet at the sewing station in accordance with a program stored in the programmable sewing machine so that said predetermined stitch pattern can be sewn thereon;

said workpiece pallet being capable of removably securing a workpiece therein when the workpiece is placed between said first and second template members and said first and second support members are fastened in said closed position so that the predetermined stitch pattern can be sewn on the workpiece when said controller energizes said drive means to move said workpiece pallet at the sewing station in accordance with said program.

16. The programmable sewing machine as recited in claim 15 wherein said programmable sewing machine further comprises:

a shuttle coupled to said controller for shuttling said workpiece pallet towards and away from the sewing station.

17. The programmable sewing machine as recited in claim 15 wherein said first template member has an aperture surrounded by a seat, said seat being capable of supporting the workpiece and said aperture having a shape which generally corresponds to said predetermined stitch pattern;

said second template member having a flange thereon which is capable of forcing the workpiece against said seat in order to retain the workpiece in the workpiece holder.

18. A method for sewing a workpiece using a programmable sewing machine, said programmable sewing machine comprising a workpiece pallet having a first frame member and a second frame member which is pivotally secured to said first frame member, a controller for controlling the operation of the programmable sewing machine, and drive means coupled to said controller for moving the workpiece pallet in accordance with a program stored in said programmable sewing machine, said method comprising the steps of:

(a) selecting a workpiece holder from a plurality of workpiece holders having cut-out portions corresponding to different predetermined stitch patterns, said workpiece holder being capable of holding the workpiece in the workpiece pallet;

(b) fastening said workpiece holder to said workpiece pallet;

(c) inserting the workpiece in the workpiece holder;

(d) causing said drive means to move said workpiece pallet at the sewing station so that a predetermined stitch pattern can be sewn on the workpiece; and (e) sewing said workpiece;

said workpiece holder including a first template member and a second template member; said step (b) further including the step of:

(b)(1) fastening said first and second template members to said first and second frame members, respectively.

19. A workpiece pallet for use in a programmable sewing machine having a sewing station, said workpiece pallet comprising:

a frame, said frame comprising a first frame member which is pivotably secured to a second frame member; and a workpiece holder detachably secured to said frame for holding a workpiece in said frame;

said workpiece holder being capable of removably securing said workpiece in said frame so that said programmable sewing machine can sew a predetermined stitch pattern on the workpiece when the workpiece pallet is positioned at the sewing station, said workpiece holder having a cut-out portion corresponding to the predetermined stitch pattern;

said workpiece pallet including a first fastener comprising a plurality of projections located on said first frame member, and a first template member comprising a plurality of apertures for receiving the plurality of projections to secure the first template member to the first frame member.

20. The workpiece pallet as recited in claim 18 including a second fastener comprising at least one post member, and a second template member comprising a slot for receiving said at least one post member, said slot having a locking member associated therewith for engaging said post member to lock said second template member onto said second frame member.

21. The workpiece pallet as recited in claim 2 wherein said second fastening means comprises a post member located on said first frame member, said second frame member comprising a slot for receiving said post member and said second frame member comprising a slidable locking member associated with said slot for cooperating with said post member to lock said first and second frame members together.

22. The workpiece pallet as recited in claim 1 wherein said securing means comprises:

a first template member; and a second template member;

said fastening means further comprising:

a first fastener for detachably fastening said first template member to said first frame member;

a second fastener for detachably fastening said second template member to said second frame member;

said first and second template members cooperating to secure the workpiece in said workpiece holder when said first and second frame members are in said closed position.

* * * * *